United States Patent [19]

Hoskinson et al.

[11] 4,388,851

[45] Jun. 21, 1983

[54] NON-VOLATILE MEMORY SYSTEM FOR AN ELECTRONIC MUSICAL INSTRUMENT

[75] Inventors: William R. Hoskinson, Elburn; Joseph C. Carley, Sycamore; Anthony C. Ippolito, DeKalb, all of Ill.

[73] Assignee: The Wurlitzer Company, DeKalb, Ill.

[21] Appl. No.: 190,215

[22] Filed: Sep. 24, 1980

[51] Int. Cl.[3] ..... G10H 1/02

[52] U.S. Cl. ..... 84/1.24; 84/345; 84/1.19

[58] Field of Search ..... 365/104; 84/1.01, 1.24, 84/115, 345, 1.19

[56] References Cited

U.S. PATENT DOCUMENTS

| | | | |
|---|---|---|---|
| 4,004,286 | 1/1977 | Mrazer | 365/104 |
| 4,078,465 | 3/1978 | Wheelwright | 84/1.01 |
| 4,129,055 | 12/1978 | Whittington et al. | 84/1.01 |
| 4,147,083 | 4/1979 | Woron et al. | 84/1.01 |
| 4,157,049 | 6/1979 | Watanabe | 84/1.24 |
| 4,184,207 | 1/1980 | McElroy | 365/104 |
| 4,185,531 | 1/1980 | Oberheim et al. | 84/1.24 |
| 4,244,259 | 1/1981 | Kolke | 84/1.19 |

OTHER PUBLICATIONS

Lancaster, CMOS Cookbook, 1977, pp. 217–218.

*Primary Examiner*—J. V. Truhe
*Assistant Examiner*—Forester W. Isen
*Attorney, Agent, or Firm*—Trexler, Bushnell & Wolters, Ltd.

[57] ABSTRACT

A non-volatile memory system for an electronic musical instrument having a plurality of player actuatable instrument controls, comprises a readable, writable memory. The memory includes addressing inputs and data input/outputs. The data input/outputs are coupled with at least selected ones of the plurality of player actuatable instrument controls. Player actuatable memory controls are also provided for selecting either the memory or the selected ones of the player actuatable instrument controls for control of the instrument.

6 Claims, 1 Drawing Figure

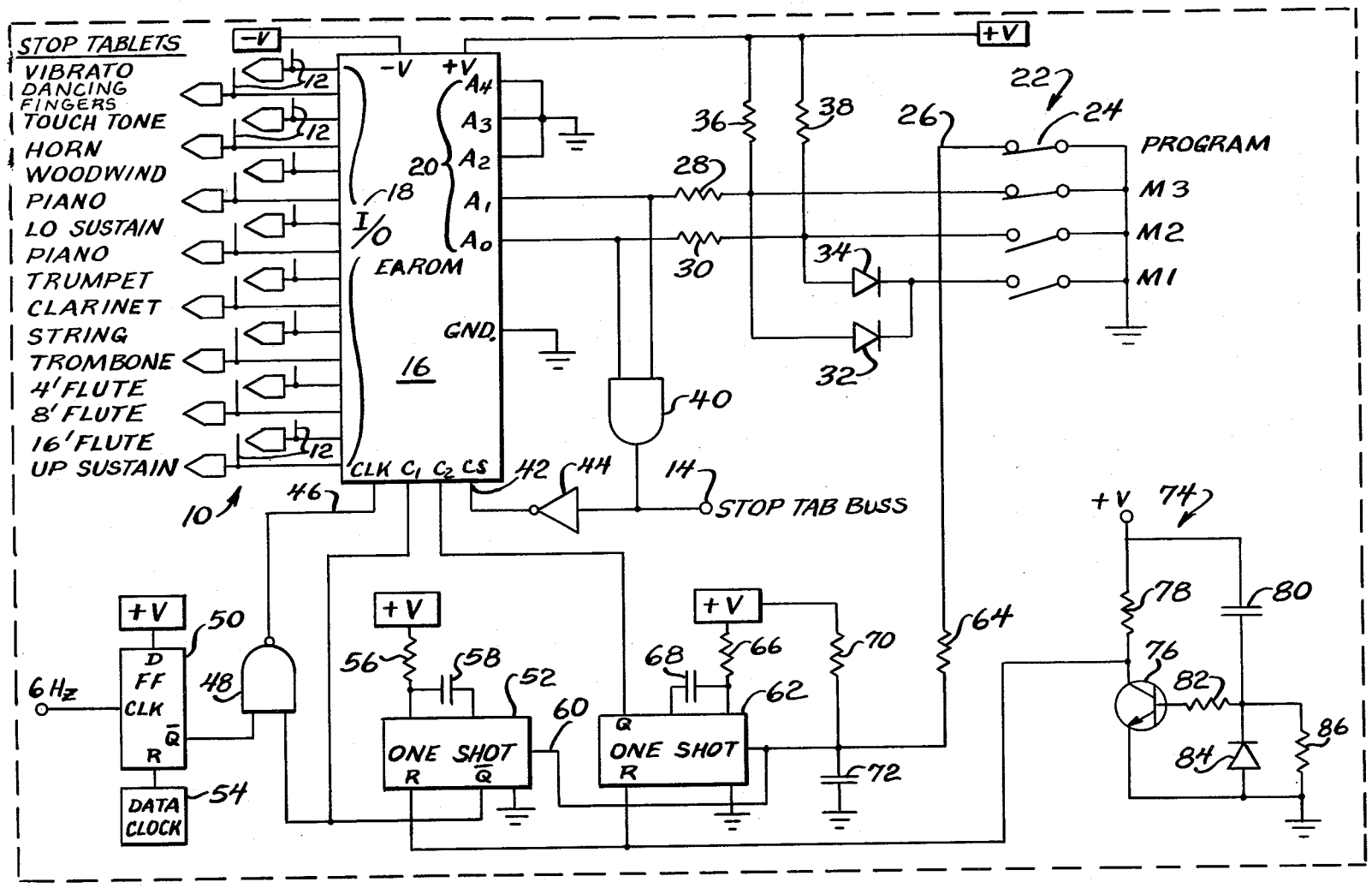
STOP TABLETS
VIBRATO
DANCING FINGERS
TOUCH TONE
HORN
WOODWIND
PIANO
LO SUSTAIN
PIANO
TRUMPET
CLARINET
STRING
TROMBONE
4' FLUTE
8' FLUTE
16' FLUTE
UP SUSTAIN
PROGRAM
M3
M2
M1
STOP TAB BUSS
EAROM
GND.
ONE SHOT
ONE SHOT
D FF
DATA CLOCK
6 Hz
+V
-V

NON-VOLATILE MEMORY SYSTEM FOR AN ELECTRONIC MUSICAL INSTRUMENT

BACKGROUND OF THE INVENTION

The present invention is directed to a non-volatile memory system for an electronic musical instrument, and more particularly to such a memory system for use in controlling the performance of the instrument, for example such as a registration memory in an electronic organ.

Generally speaking, keyboard instruments such as organs are provided with a number of different performance control features for controlling the pitch and overall sound quality of the tones produced in response to playing on the keyboard of the instrument. Generally, these controls are in the form of player-actuated stop tablets, each stop tablet controlling a particular voice or a particular musical effect which is to be imparted to the music performed. For example, typical organ stop tablets provide voices having tonal qualities identified as various orchestral instruments which they simulate, such as flute, trombone, string, trumpet or the like. Additionally, effects such as sostenuto, vibrato, and the like may be imparted to the performed music by actuation of a suitable stop tablet.

In the past, many organs have been provided with registration preset systems. Briefly, such systems permit a number of stop tablets to be actuated in advance of the performance requiring their use, and such a combination of actuated stop tablets is generally referred to as the registration for that performance. Various mechanical linkages have been heretofore provided for the stop tablets, such that actuation of a single registration tablet or other control member will alternatively bring into play or cancel a given combination of stop tablets.

In modern electronic musical instruments, similar stop tablets are used to control both tonal quality and musical effects of a performance. However, it has been the aim of such electronic musical instrument design to maximize the use of low cost, reliable electronic integrated circuit components, and minimize the use of mechanical control elements. Hence, while such a mechanical registration or preset system may readily be utilized with the stop tablets of such an electronic instrument, the use of such a mechanical system departs from this goal.

OBJECTS AND SUMMARY OF THE INVENTION

Accordingly, it is a general object of this invention to provide an electronic registration or preset system for an electronic musical instrument.

A more specific object is to provide a non-volatile memory system for registration or preset control in an electronic musical instrument.

A related object is to provide such a non-volatile memory system which comprises relatively few electronic components so as to be relatively simple and inexpensive in its design and manufacture and highly reliable in operation.

Briefly, and in accordance with the foregoing objects, a non-volatile memory system for an electronic musical instrument having a plurality of player actuatable instrument control means, comprises readable, writable memory means including addressing input means and data input/output means. The data input/output means is coupled with at least selected ones of the plurality of player actuatable instrument control means. Player actuatable memory control means are provided for selecting one of said memory means or said selected ones of said player actuatable instrument control means for control of said instrument.

BRIEF DESCRIPTION OF THE DRAWINGS

Other objects, features and advantages of the invention will become more readily appreciated upon reading the following detailed description of the illustrated embodiment, together with reference to the accompanying drawing wherein:

FIG. 1 is a circuit schematic diagram of a non-volatile memory system in accordance with the present invention.

DETAILED DESCRIPTION OF THE ILLUSTRATED EMBODIMENT

Referring now to the drawing, a non-volatile memory system for an electronic musical instrument is illustrated as a registration control or preset system. Conventionally, the electronic musical instrument includes a plurality of stop tablets and their associated switches, designated generally by the reference numeral 10, which are utilized to control the sound quality and overall musical effects of a performance on the instrument. Briefly, these stop tablet switches may control either the tonal quality of notes produced or such musical effects as vibrato, sostenuto or the like. Each of these stop tablets or stop tabs 10 is coupled with a control line, designated generally by the reference numeral 12, which carries a signal developed at the associated stop tablet 10 in response to the actuated or unactuated condition thereof, to responsive circuits for carrying out the corresponding control of the instrument.

For example, actuation of one of the stop tablets 10 puts the stop tablet in electrical contact with a stop tablet or stop tab bus 14 to which a suitable potential or voltage is applied. Accordingly, by providing suitable voltages, a pair of binary control signals, corresponding to conventional digital logic "0" and "1" levels may be obtained in response to the actuation or non-actuation of each of the stop tablets 10.

Departing from convention, an erasable and programmable read-only memory (EAROM) 16 includes a plurality of input/output (I/O) terminals or ports, designated generally by the reference numeral 18. These I/O ports 18 are coupled respectively to the instrument control lines 12, in common with respective ones of the stop tabs 10. In accordance with a feature of the invention, as will be more fully described hereinbelow, the EAROM 16 has a plurality of selectable outputs to the I/O ports 18 for alternative control of the instrument performance, whereby either the stop tabs 10 or the EAROM 16 may be selected by the player for performance or registration control of the instrument.

The EAROM 16 also includes a plurality of address inputs or ports, designated generally by the reference numeral 20. In the illustrated embodiment, only two of these address ports $A_0$ and $A_1$ are utilized. As a specific example, to which no limitation is intended, the EAROM 16 of the illustrated embodiment comprises an integrated circuit component of the type generally designated 2051, available for example from General Instrument Company. Briefly, the illustrated EAROM is arranged in a 32 word, 16-bit array, however, in the illustrated embodiment only three 16-bit words are utilized. Accordingly, only the two address ports $A_0$ and $A_1$ are required for selectively addressing one of these three, 16-bit words, utilizing a 2-bit binary address code.

Advantageously, the EAROM 16 thus comprises a plurality of data words, each of which may be utilized to memorize or store one particular combination of actuated and unactuated stop tablets 10, when the I/O ports 18 are utilized as input ports to write this data into the EAROM 16. In this regard, each stop tablet 10 may be regarded as an individual data bit, while each data word may be regarded as a given registration, comprising one combination of actuated and unactuated stop tablets 10.

A memory control system is also illustrated for controlling the operation of the EAROM 16. This memory control is manually actuatable to effect reading of data or information from the memory 16 onto the lines 12 for control of the instrument or writing of stop tablet data or information into the memory 16 from the stop tablets 10 for purposes of "programming" a registration. Further, manually actuatable controls permit addressing one of the plural separate words for reading in or writing out registrations to or from the EAROM 16.

Briefly, the memory control system includes a plurality of player actuatable controls designated generally by the reference numeral 22, which take the form of simple on-off switches. A first one of these switches 24 is designated as a "program" switch, and is coupled for selectively grounding a control line 26. Three additional switches, designated generally M1, M2 and M3 comprise memory addressing switches for addressing the EAROM 16. These switches M1, M2 and M3 each grounds a corresponding circuit point when actuated, and in particular, the switch M3 provides a ground signal to the addressing terminal $A_1$ by way of a series-connected resistor 28, while the switch M2 provides a ground level to the addressing terminal $A_0$ by way of a series-connected resistor 30. The remaining memory addressing control switch M1 provides a ground potential to the cathode electrodes of a pair of diodes 32, 34, whose anode electrodes are respectively coupled in series with the resistors 28 and 30 to the address inputs $A_1$ and $A_0$ of the EAROM 16. A pair of pull-up resistors 36, 38 are also provided from a suitable positive voltage supply to the respective junctions of the diodes 32 and 34 with the resistors 28 and 30.

A suitable logic level or voltage is provided to the stop tab bus 14 from the output of a two-input AND gate 40 whose inputs are respectively coupled with the address terminals $A_0$ and $A_1$. Hence, the stop tab bus 14 receives either a logic 1 or a logic 0 level depending on the state of the memory control switches 22. In particular, when the program switch 24 is activated, a logic 1 or high level signal is fed through the stop tab bus 14, so that actuation of any of the stop tablets 10 will result in a similar logic 1 or high level being imparted to the corresponding instrument control line 12 as well as to the corresponding I/O port 18 of the EAROM 16. The stop tab bus 14 is also fed to a CS control terminal 42 of the EAROM 16 by way of a series-connected inverter buffer 44.

Additional circuits shown in the drawing are also provided for control of the operation of the EAROM 16. Briefly, a data control clock signal for controlling the reading and writing operation of the EAROM 16 is provided at a control terminal 46 thereof from the output of a two-input NAND gate 48. One input of this NAND gate 48 is fed from a Q output of a flip-flop circuit 50 while the other input of the NAND gate 48 is fed from the Q output of a one-shot circuit 52. The flip-flop 50 includes a reset input R which is fed from a main or master data clock 54 and a clock input which is fed from a second control frequency source of on the order of 6 hertz, in the illustrated embodiment.

The one-shot circuit 52 utilizes a suitable RC timing control circuit comprising a resistor 56 and capacitor 58 from a positive voltage supply to suitable control terminals of the one-shot 52. In the illustrated embodiment, the values of the resistor 56 and capacitor 58 are such as to provide a pulse width output of substantially 200 milliseconds at the Q terminal of the one-shot circuit 52. The one-shot 52 is triggered from a line 60, which also feeds a trigger input terminal of a second one-shot circuit 62. This triggering line 60 is fed from the program control switch 24 by way of a series-connected resistor 64. The Q terminal of the one-shot 52 also feeds a control input $C_1$ of the EAROM 16, while the Q output of the second one-shot 62 feeds a similar, $C_2$ control input of the EAROM 16. The one-shot 62 is provided with a similar RC timing circuit comprising a resistor 66 and a capacitor 68, whose values are chosen for a pulse width output of substantially 100 milliseconds at the Q output thereof. A suitable pulse forming network comprising a resistor 70 and a capacitor 72 is also coupled to the triggering input line 60.

The two one-shot circuits 52, 62 have their reset terminals R fed in common from a power-up control circuit 74. This circuit 74 is designed to hold the reset terminals of the one-shots 52, 62 clamped low during "power-up" of the circuit to ensure the proper beginning logic levels throughout the illustrated circuits. This circuit 74 comprises an NPN transistor 76 whose collector electrode is coupled with a positive voltage supply by way of a series resistor 78, and whose base electrode is coupled with this same positive voltage supply by way of a capacitor 80 and a resistor 82. A diode 84 has its cathode terminal joined to the junction of the capacitor 80 with the resistor 82 and its anode terminal tied to ground. A further resistor 86 is tied in parallel with the diode 84, while the emitter electrode of the transistor 76 is grounded.

In operation, one of the sections of the memory 16 is selected by actuation of one of the three memory selection switches M1, M2 or M3. A resulting 2-bit binary code at the addressing inputs $A_0$, $A_1$ of the EAROM 16 will result in selection internally of a given 16-bit memory word. This word may then be read out onto the instrument control lines 12, or alternatively programmed or written in in accordance with the states of the stop tablets 10. If the program control switch 24 is not in contact with the line 26, the selected memory word is read out and at the same time the stop tab bus 14 is fed a logic 0 signal so that the stop tablets 10 are inactive. Accordingly, the word read out of the EAROM 16 is utilized for control of the instrument by way of the control lines 12.

Alternatively, if it is desired to program a given combination of actuated and unactuated stop tablets 10 into the selected memory location or word, the program switch 24 is actuated into contact with the line 26. The one-shots 52 and 62 are then activated thereby feeding 200 millisecond and 100 millisecond control pulses to the control terminals $C_1$ and $C_2$ respectively. The EAROM 16 responds by erasing the data content of the selected data word therein and subsequently programming or writing the actuated and unactuated conditions of the stop tablets 10 into that memory location or word. At the same time, the stop tab bus 14 is set to a logic 1 level so that the logic 1 level is present at any actuated stop tablet 10.

Additionally, with the program switch 24 actuated into contact with the line 26, the active or logic 1 state of the stop tab bus permits a logic 1 to be fed onto the instrument control line 12 for each actuated stop tablet 10. Accordingly, the instrument performance is controlled by the stop tablets 10 rather than the EAROM 16 while in the "program" mode.

What has been illustrated and described herein is a novel non-volatile memory system for registration control of an electronic musical instrument. While a specific embodiment has been illustrated and described herein, the invention is not limited thereto. On the contrary, alternatives, changes and modifications may become apparent to those skilled in the art from the foregoing descriptions. Accordingly, the invention includes such alternatives, changes and modifications insofar as they fall within the spirit and scope of the appended claims.

The invention is claimed as follows:

1. A memory system for an electronic musical instrument having a plurality of player actuatable instrument control means, comprising: an EAROM readable, writable memory means having a predetermined number of multibit words and including addressing input means, data input/output means, and erase/write control input means, said data input/output means being coupled with at least selected ones of said plurality of player actuatable instrument control means, for inserting manually determined combinations of said control means respectively in said memory means words, and a single manually operable means connected to said erase/write control input means for erasing only a single word from said memory means and immediately thereafter writing in a new word as a result of a single operation of said manually operable means, and player actuatable memory control means for selecting one of said multibit words of said memory means and said selected ones of said player actuatable instrument control means for erasing and rewriting with selected one of said multibit words.

2. A memory system according to claim 1 wherein said player actuatable memory control means further includes means for selectively writing into said memory means data corresponding to the actuated or unactuated condition of each of said selected ones of said player actuatable instrument control means.

3. A memory system according to claim 1 wherein said instrument is responsive to control signals received on a plurality of instrument control lines and wherein said player actuatable instrument control means and said data input/output means of said readable, writable memory means are coupled in common to respective ones of said plurality of instrument control lines for alternatively feeding said control signals thereto.

4. A memory system according to claim 1 wherein said EAROM includes a plurality of separately addressable memory sections for writing and reading a like plurality of different combinations of data corresponding to different combinations of actuated and unactuated ones of said selected ones of said plurality of said player actuatable instrument control means.

5. A memory system for an electronic musical instrument having a plurality of player actuatable instrument control means, comprising: an EAROM readable, writable memory means including addressing input means, data input/output means, and erase/write control input means, said data input/output means being coupled with at least selected ones of said plurality of player actuatable instrument control means, and a single manually operable means connected to said erase/write control input means for erasing a word from said memory means and immediately thereafter writing in a new word as a result of a single operation of said manually operable means, and player actuatable memory control means for selecting one of said memory means and said selected ones of said player actuatable instrument control means for control of said instrument, said erase/write control input means comprising two input connections, and further including two one-shot circuits respectively connected to said two input connections and both connected in common to said single manually operable means.

6. A memory system as set forth in claim 5 wherein one of said one-shot circuits has a relatively short time constant and the second thereof has a relatively long time constant, both of said circuits initially operating for erase and the second thereof operating independently for write.

* * * * *

UNITED STATES PATENT AND TRADEMARK OFFICE

CERTIFICATE OF CORRECTION

PATENT NO. : 4,388,851

DATED : June 21, 1983

INVENTOR(S) : WILLIAM R. HOSKINSON, JOSEPH C. CARLEY, AND ANTHONY C. IPPOLITO

It is certified that error appears in the above-identified patent and that said Letters Patent is hereby corrected as shown below:

Column 4, line 3, change "from the Q output" to --from the $\overline{Q}$ output--;

Column 4, line 19, change "The Q terminal" to --The $\overline{Q}$ terminal--.

Signed and Sealed this

*First* Day of *November 1983*

[SEAL]

*Attest:*

GERALD J. MOSSINGHOFF

*Attesting Officer*

*Commissioner of Patents and Trademarks*